United States Patent [19]

Huber et al.

[11] Patent Number: 4,486,118

[45] Date of Patent: Dec. 4, 1984

[54] ARRANGEMENT FOR BRIDGING EXPANSION JOINTS IN CARRIAGE WAYS, ESPECIALLY BRIDGES

[76] Inventors: Reinhold Huber, Winzerweg 21, Bulach CH8180, Switzerland; Waldemar Koster, Im Tentefeld 17, Forsbach D-5062, Fed. Rep. of Germany

[21] Appl. No.: 513,928

[22] Filed: Jul. 14, 1982

[30] Foreign Application Priority Data

Jul. 19, 1982 [CH] Switzerland ..... 3226970

[51] Int. Cl.[3] ..... E01C 11/02

[52] U.S. Cl. ..... 404/56

[58] Field of Search ..... 404/50, 51, 52, 53, 404/54, 55, 56, 57, 58, 59, 60, 61, 62, 63; 52/1, 573

[56] References Cited

U.S. PATENT DOCUMENTS 3,482,492 12/1969 Bowman ..... 404/56

3,604,322 9/1971 Koster ..... 404/53

*Primary Examiner*—Stephen J. Novosad

*Assistant Examiner*—Bruce M. Kisliuk

[57] ABSTRACT

An arrangement for bridging expansion joints in carriageways, especially bridges. One or more parallel plates run at right-angles to the direction of the carriageway adjacent at the top to the surface of the carriageway. The plates are supported at the bottom on bars which run at right-angles to the expansion joint and transmit loads directly or indirectly into the edges of the joint adjacent thereto. For controlling the spacing of the plates, control cables are provided. The plates are connected to the cable runs of the control cables. The cable runs run parallel to the bars and are attached either to the load-transmitting bars themselves or to separate control bars.

8 Claims, 4 Drawing Figures

ARRANGEMENT FOR BRIDGING EXPANSION JOINTS IN CARRIAGE WAYS, ESPECIALLY BRIDGES

BACKGROUND OF THE INVENTION

1. Field of the Invention

The invention relates to an arrangement for bridging expansion joints in carriageways, especially bridges, having one or more parallel plates which run at right-angles to the direction of the carriageway, are adjacent at the top to the surface of the carriageway and are supported at the bottom on bars which run at right-angles to the expansion joint and transmit loads directly or indirectly into the edges of the carriageway adjacent thereto, and wherein a device for controlling the spacing of the plates is provided.

2. Description of the Prior Art

In known arrangements of that type (for example German patent specifications Nos. 16 58 611 and 30 19 594), it is necessary to control the spacings between the plates in conformity with the width, in each case, of the expansion joints and also as a reaction to the braking and traction forces of vehicles passing over.

Numerous control devices are known which bring about the control of the plates in such a manner that these uniformly divide the joint gap by using different means such as articulated levers, scissor rods, toothed racks, elastic control parts or the like.

The known lever controls (for example German Offenlegungsschrift No. 24 21 964) do not have any shock-absorbing action; in time their joints deflect.

The known elastic control devices (for example German patent specifications Nos. 16 58 611 and 30 19 594) are less accurate than the lever controls mentioned, their inaccuracy increasing as the deflecting forces decrease and as the rubber control parts age.

SUMMARY OF THE INVENTION

The invention provides a device for bridging expansion joints in carriageways comprising: at least one plate which runs at right angles to the carriageway and defines a top surface adjacent to the surface of the carriageway; a plurality of bars which run at right angles to the expansion joint and at least some of which support said plates from beneath and transfer loads to the edges of the carriageway adjacent to the joint; a plurality of control cables; means on a corresponding plurality of said bars guiding each said control cable in a closed path fixed with respect to a respective said bar and forming two straight cable runs parallel to the respective said bar; means fixing each said bar that has a control cable to a said plate at a central region of said bar; and a connection between each said cable run and one selected from other said plates and edge portions of the carriageway, the length of said cable runs being at least equal to the horizontal distance between said connections when the expansion joint is at its maximum opening.

The sequential control proposed according to the invention permits the control of a single plate, occasional plates or each plate of the bridging arrangement. Control is effected via load-transmitting bars and/or via additional, non-load-transmitting bars serving for control, so-called control bars. Bars, including control bars, are rigidly connected in each case only to one plate; each of the cable runs provided at the bars is connected to one plate or one edge of the carriageway.

If there is only one single plate, then the bars on which this plate is supported bridge the expansion joint and each of the cable runs is connected to one edge of the carriageway.

If there are a plurality of plates, then the plates adjacent to the edge of the carriageway in each case are connected to bars, the control cables of which are fastened by one cable run to the edge of the joint and by the other cable run to the adjacent plate. In the case of an arrangement of the type mentioned in the introduction having only two plates, this applies to each of those plates. In the case of an arrangement having more than two plates, the central plates are fastened to bars, each of the cable runs of which is connected to an adjacent plate. Other suitable plates, instead of the adjacent plates, are those which are further from the fastening place of the controlling bar but are, in each case, equal distances away from the fastening place.

The invention can also be used for those arrangements in which, apart from load-transmitting bars, there are also so-called control bars which bridge only a portion of the expansion joint, that is to say, do not run from one edge of the carriageway to the other. A plurality of control bars of that type, each of which is rigidly connected to one plate, bridge the whole expansion joint in staggered arrangement, each control bar being provided with one control cable. It is advantageous that each of the two plates adjacent to a particular plate is coupled to one cable run of the control bar rigidly connected to the particular plate. The continuous control chain composed of control bars of that type can serve simultaneously to take up vertical loads if the plates not rigidly connected to a control bar, for example controlled by the latter, are slidably supported on the control bar or are supported via shear-deformable elastic bearing members (see German patent specification No. 30 19 594).

Within the framework of the invention, it is obviously possible not to control all the plates in the manner mentioned but, for example, to control only every second, third, etc. plate and to arrange between them uncontrolled plates which are horizontally supported with respect to one another and with respect to the controlled plates via elastic sealing sections which are between all the plates.

The cable control proposed according to the invention is sufficiently elastic, owing to the extension of the cable, that disruptive sudden loads are avoided; it is also, however, within the framework of the permitted extension, sufficiently accurate that even in the case of relatively small deflection forces control movements are obtained as a result of which the plate rigidly connected to a controlling bar is positioned centrally between the two plates controlled by this bar or between a controlled plate and one edge of the joint.

It is thus an object of the invention to provide a control device for an arrangement of the type mentioned in the introduction, which control device operates with a high degree of accuracy, reacts directly to any deflection caused by traffic loads and avoids a jerky transmission of force.

Other objects, features and advantages of the present invention will be apparent to those skilled in the art from the following description.

DESCRIPTION OF THE PREFERRED EMBODIMENT

Figure 1:
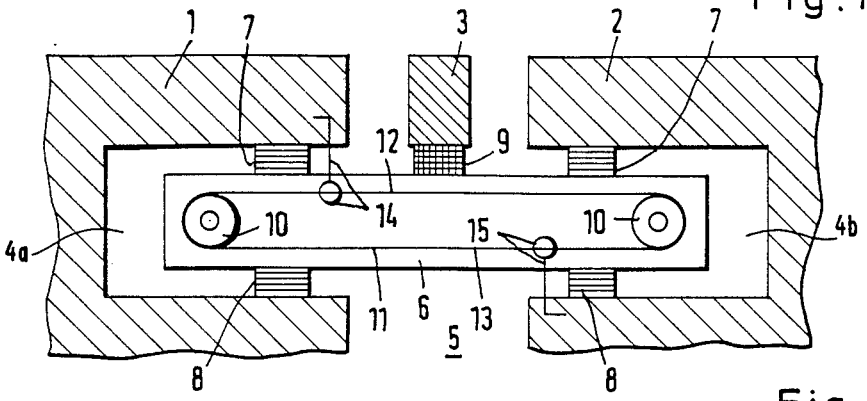
FIG. 1 shows a vertical cross-section through a bridging arrangement having only one plate.

Referring to FIG. 1 of the drawings, a single plate 3 is arranged between a left-hand edge portion 1 of a carriageway and a right-hand edge portion 2 of a carriageway. In recesses 4*a*, 4*b* respectively in the edge portions 1 and 2 of the carriageway the ends of a load-transmitting bar 6 which bridges the joint gap 5 are displaceably mounted between upper bearing parts 7 and lower bearing parts 8. The plate 3 is supported on the bar 6 by being rigidly connected to the bar 6 via an intermediate element 9. The edge portions 1 and 2 of the carriageway on either side of the joint preferably consist of concrete, but may also be reinforced in the region of the edges by a steel structure. Plate 3, bar 6 and intermediate element 9 preferably consist of steel, the intermediate element 9 being welded, on the one hand, to the plate 3 and, on the other hand, to the bar 6. The bearing parts 7 and 8 are preferably plastics blocks, for example consisting of neoprene, that are elastically pre-stressed in the vertical direction. On one side of the bar 6, there are fastened at the two ends reversing pulleys 10 over which a control cable 11 is guided. The control cable 11 preferably comprises a closed cable loop in the form of an endless cable, the ends of the cable being connected by means of a tensioning device or wire strainer (not shown in detail). The control cable may also, however, be interrupted at any fastening place. The control cable 11 comprises two cable runs, namely an upper cable run 12 and a lower cable run 13. The upper cable run 12 is connected via a fastening point in the form of a clamp 14 to the left-hand edge 1 of the joint and the lower cable run 13 is connected via a further clamp 15 to the right-hand edge 2 of the joint. The gaps between the two edge portions 1 and 2 of the joint and the plate 3 are sealed by means of elastic sealing sections (not shown). Any change in the width of the joint gap 5 causes a corresponding movement of the two clamps 14 and 15 away from or towards each other, which necessarily maintains the plate 3 in a central position. Obviously the plate 3 is supported on a plurality of bars 6, the number of bars depending on the width of the carriageway but being at least two.

Figure 2:
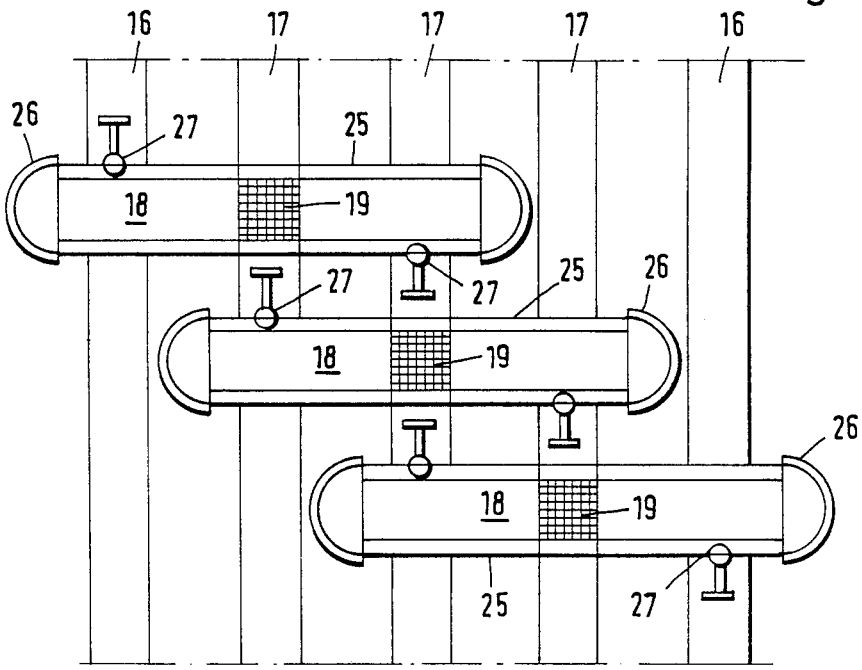
FIG. 2 shows a bottom view of a bridging arrangement having a plurality of plates and so-called control bars.

FIG. 2 shows a portion from a bridging arrangement for a broad expansion joint, five plates being shown in a bottom view. The two outer plates 16 can be conceived of equally either as freely movable plates, as are the three central plates 17 or as edge plates rigidly connected to the edges of the carriageway. As far as the control principle is concerned, this does not make any difference. If the outer plates 16 represent edge plates, the three control bars 18 shown, which serve merely for control and thus do not transmit any vertical loads, can form a closed control chain connecting the two edges of the carriageway; otherwise, this control chain would be continued by further control bars. The bars transmitting vertical loads do not appear in the portion of the joint shown in FIG. 2.

Figure 3:
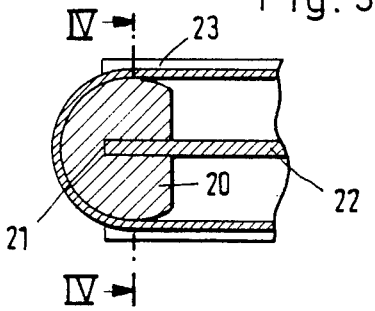
FIG. 3 shows a horizontal section through one end of a control bar.

Each of the connecting points 19 of the control bars 18 to the plates 17 associated therewith is indicated by a grid-like structure. At the ends of the control bars 18, reversing elements 26 having semi-circular guideways are provided. As shown in FIG. 3, these reversing elements may be clamp parts 20 shaped from hard elastomer, each of which clamp parts is fixed onto the end portion 21 of the cross-piece 22 of a double-T-section member 23 forming one of the control bars 18. The elastomeric clamp part 20 advantageously assists in providing the elasticity of the control system. Instead of those reversing elements 26, it is also possible to provide cable pulleys that rotate about vertical axes.

Figure 4:
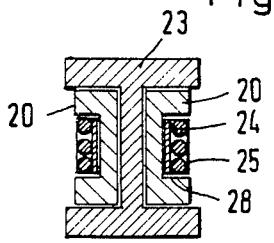
FIG. 4 shows a section on the line IV—IV of FIG. 3.

The sectional representation according to FIG. 4 shows a clamp part 20 as described above with reference to FIG. 3 having a recessed guideway 24 in which a strip-shaped control cable 25, which is composed of three adjacent single cables and a coating 28 of low-friction material, for example PTFE, is slidably guided. Control cables 25 of that type also encircle the control bars 18 shown in FIG. 2, in such a manner that the opposed cable runs of these control cables lie in horizontal planes. The two cable runs are freely tensioned between two opposed reversing elements 26 and each of them is connected, by a clamp 27 to a plate 16 or 17. All horizontal displacements introduced through a single plate or from the edges of the carriageway are transmitted by means of the control cables 25 to all plates or edges of the carriageway, with the result that the plates 16 and 17 are adjusted in such a manner that the spacings between plates and the spacings of the outer plates from the edges of the carriageway are of equal size.

While preferred embodiments of the present invention have been described, it should be understood that the invention is not limited thereto and is determined soley by the scope of the appended claims.

What is claimed is:

1. A device for bridging expansion joints in carriageways comprising: at least one plate which runs at right angles to the carriageway and defines a top surface adjacent to the surface of the carriageway; a plurality of bars which run at right angles to the expansion joint and at least some of which support said plates from beneath and transfer loads to the edges of the carriageway adjacent to the joint; a plurality of control cables; means on a corresponding plurality of said bars guiding each said control cable in a closed path fixed with respect to a respective said bar and forming two straight cable runs parallel to the respective said bar; means fixing each said bar that has a control cable to a said plate at a central region of said bar; and a connection between each said cable run and one selected from other said plates and edge portions of the carriageway, the length of said cable runs being at least equal to the horizontal distance between said connections when the expansion joint is at its maximum opening.

2. A device according to claim 1, wherein said bars that have control cables are selected from said load-transmitting bars and additional control bars.

3. A device according to claim 1, wherein there are connected to said runs of each said control cable respective edges of the carriageway or one said plate and one edge of the carriageway or two said plates which are arranged on different sides and at the same distance away from said plate fixed to the respective said bar.

4. A device according to claim 1, comprising opposed guideways round which each said control cable round its respective said bar in a horizontal plane.

5. A device according to claim 1, comprising pulley rollers rotatably fastened to said bars over which said control cables are guided.

6. A device according to claim 1, comprising reversing elements consisting of elastomeric material, which are fastened to end faces of said bars and round which said control cables are turned.

7. A carriageway including an expansion joint and a device as claimed in claim 1 bridging said expansion joint.

8. A bridge having a carriageway, an expansion joint in said carriageway, and a device as claimed in claim 1 bridging said expansion joint.

* * * * *

UNITED STATES PATENT AND TRADEMARK OFFICE

CERTIFICATE OF CORRECTION

PATENT NO. : 4,486,118

DATED : December 4, 1984

INVENTOR(S) : Reinhold Huber and Waldemar Koster

It is certified that error appears in the above-identified patent and that said Letters Patent is hereby corrected as shown below:

On the title page;

item [30] under "Foreign Application Priority Data" change "Switzerland" to --(West) Germany--.

On the title page insert--(73) Assignee: Kober AB., Switzerland--.

Signed and Sealed this

*Twenty-third* Day of *July 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,486,118

DATED : December 4, 1984

INVENTOR(S) : Reinhold Huber & Waldemar Koster

It is certified that error appears in the above-identified patent and that said Letters Patent is hereby corrected as shown below:

On the title page:

Item [22] change "July 14, 1982" to --July 14, 1983--.

Signed and Sealed this

Twenty-fourth Day of January, 1989

*Attest:*

DONALD J. QUIGG

*Attesting Officer*

*Commissioner of Patents and Trademarks*